United States Patent [19]

de Winter et al.

[11] Patent Number: 4,522,908

[45] Date of Patent: Jun. 11, 1985

[54] LIQUID ELECTROPHORETIC DEVELOPER

[75] Inventors: Walter F. de Winter, 's-Gravenwezel; Herman J. Uytterhoeven, Bonheiden; Yvan K. Gilliams, Hever; Noël J. De Volder, Edegem, all of Belgium

[73] Assignee: AGFA-Gevaert N.V., Mortsel, Belgium

[21] Appl. No.: 617,708

[22] Filed: Jun. 6, 1984

[30] Foreign Application Priority Data

Jun. 10, 1983 [EP] European Pat. Off. ..... 83200852.8

[51] Int. Cl.[3] ..... G03G 9/12

[52] U.S. Cl. ..... 430/114; 430/115; 430/904

[58] Field of Search ..... 430/114, 115, 904

[56] References Cited

U.S. PATENT DOCUMENTS 3,933,667 1/1976 Machida et al. ..... 430/114

*Primary Examiner*—John D. Welsh

*Attorney, Agent, or Firm*—William J. Daniel

[57] ABSTRACT

A liquid electrophoretic developer composition suitable for rendering visible electrostatically charged areas, which composition contains in an electrically insulating non-polar organic carrier liquid having a volume resistivity of at least $10^9$ ohm.cm and a dielectric constant less than 3, pigment particles carrying at least one substance conferring electric charges on said particles, dispersed with the aid of a block copolymer containing one adsorbent group A and at least one solvatable group B, characterized in that said group A represents a polystyrene chain having a number average molecular weight of at least 2,000, and said group B represents a polymethacrylate fatty alcohol ester chain having a number average molecular weight of at least 7,000. The adsorption of said block copolymer to pigment particles is illustrated in FIG. 1.

12 Claims, 3 Drawing Figures

LIQUID ELECTROPHORETIC DEVELOPER

The present invention relates to an improved liquid electrophoretic developer for the development of electrostatic charge patterns.

In electrostatography an electrostatic image is made visible, i.e. developed, by charged toner particles.

In electrophotography an electrostatic image is obtained with an electrophotographic material typically comprising a coating of a photoconductive insulating material on a conductive support. Said coating is given a uniform surface charge in the dark and is then exposed to an image pattern of activating electromagnetic radiation such as light or X-rays. The charge on the photoconductive element is dissipated in the irradiated area to form an electrostatic charge pattern which is then developed with an electrostatically attractable marking material also called toner. The toner image may be fixed to the surface of the photoconductive element or transferred to another surface and fixed thereon. Instead of forming the electrostatic image by the steps described above it is also possible to charge directly a dielectric material in image configuration e.g. with a charged stylus, or through photo-electron emission or ionography.

Historically, a one-component dry powder toner was first used for developing electrostatic images. Other development processes, presently known as cascade, fur brush, powder cloud, magnetic brush and liquid electrophoretic development were introduced.

Developers of the electrophoretic type initially comprised basically a simple dispersion of a pigment but no binder. It was later proposed, e.g. by Metcalfe and Wright, J. Oil Colour Chem. Ass., 39 (1956) 851–853, to use liquid developers incorporating resins and control agents. The resultant images are then made of so-called "self-fixing" toners. In liquid developers comprising coloured toner particles suspended in an insulating carrier liquid, the volume resistivity of the liquid is preferably in excess of $10^9$ Ohm·cm and has a dielectric constant below 3. The suspended toner particles, which usually comprise finely divided pigments (which expression includes organic dyes in pigment form), obtain an electric charge of a definite polarity by a so-called charge control agent and develop the latent image under influence of the charge of the latent electrostatic image.

The charging of the toner particles can be achieved by the addition of oil-soluble ionogenic substances e.g. metallic salts of organic acids with sufficiently long aliphatic chains. By predominant adsorption of one ionic species the particles receive a net charge, the amount of which can be regulated simply by changing the additive concentration. The polarity is controlled by the appropriate choice of ionogenic substance. For example, a suspension of carbon black in liquid isoparaffins becomes positively charged by calcium diisopropylsalicylate and by the organic phosphorus compounds described in the United Kingdom Patent Specification No. 1,151,141.

Negatively charged toner particles can be obtained by using as charge control agent overbased metal alkyl sulphonates (oil-soluble micelles of metal alkyl sulphonates with excess metal hydroxide or solubilized carbonates) as described in Proc. IEEE, Vol. 60, No. 4, April 1972, page 363 and United Kingdom Pat. No. 1,571,401.

According to the United Kingdom Patent Specification No. 1,572,343 an electrophoretic liquid developer is provided in which the liquid has a volume resistivity in excess of $10^9$ Ohm·cm and a dielectric constant below 3, and wherein pigment particles are dispersed with the aid of polymer molecules that are attached to said particles and improve their dispersion stability through the steric environment built up by said molecules. More particularly said developer comprises at least one substance influencing or conferring electric charges on the toner particles which particles comprise a particulate colouring substance bearing a copolymer containing the following recurring units (A) and (B) or (A) and (C):

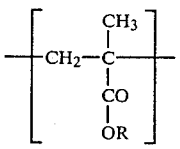

(A)

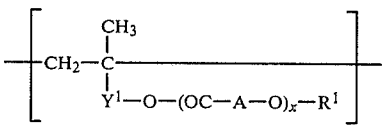

(B)

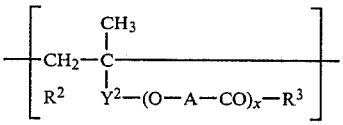

(C)

wherein:

R represents an alkyl group of 1 to 4 carbon atoms, preferably an isobutyl group, $R^1$ represents hydrogen or an acyl group, e.g. an aliphatic acyl group containing an alkyl chain of 1 to 18 carbon atoms, $R^2$ represents hydrogen or carboxyl in free acid or salt form, $R^3$ represents hydroxyl or an ether group e.g. an alkoxy group containing preferably an alkyl chain of 12 to 18 carbon atoms, A represents an alkylene chain of 12 to 20 carbon atoms, preferably of 17 carbon atoms, $Y^1$ represents —CO—O—$CH_2$—CHOH—$CH_2$—, $Y^2$ represents —CO—, and x represents 4 to 20.

In the above defined resin the recurring units represents by (B) and (C) form the solvatable part of the polymer molecule whereas part (A) operates as an adsorbent to adhere to the pigment particles in said liquid. The solvatable part constitutes preferably at least 50% by weight of the copolymer.

The above copolymers are graft-copolymers. The use of random block or graft-copolymers in the preparation of a liquid developer for xerographic images has been described in United Kingdom Patent Specification No. 1,186,562. According thereto the liquid developer contains dispersed in the carrier, liquid polymer particles comprising in admixture at least two compatible copolymers one less polar than the other, the more polar copolymer providing a field extending component and the less polar copolymer serving to disperse the particles in the carrier liquid.

The idea of using block or graft copolymers as dispersion stabilizers for pigment particles is also described in Advances in Colloid and Interface Science, 4, 193–277 (1974) p. 199. For that purpose a copolymer with polymer part A is chosen to be insoluble in the dispersion medium and to have a strong affinity for the particle surface and a polymer part B is chosen to be soluble in the dispersion medium and to have little or no affinity for the particle surface.

It is one of the objects of the present invention to provide a liquid electrophoretic developer containing a substantially stable dispersion of toner particles.

It is another object of the present invention to provide a liquid electrophoretic developer containing a toner of substantially uniform particle size and which is substantially free of agglomeration.

It is still another object of the present invention to provide a liquid electrophoretic developer wherein the liquid has a low conductivity because of the presence of charge control agent in a dose not larger than necessary for charge determination of the toner particles, the dispersion stability being mainly due to adsorbed block copolymer.

According to the present invention a liquid electrophoretic developer composition is provided that is suitable for rendering visible electrostatically charged areas, which composition contains in an electrically insulating non-polar organic carrier liquid having a volume resistivity of at least $10^9$ ohm·cm and a dielectric constant less than 3, pigment particles, e.g. carbon black particles, carrying at least one substance conferring electric charges on said particles, which are dispersed with the aid of a block copolymer containing one adsorbent group A and at least one solvatable group B, characterized in that group A is a polystyrene chain having a number average molecular weight of at least 2,000, preferably between 2,000 and 6,000, and said group B is a polymethacrylate fatty alcohol ester chain having a number average molecular weight of at least 7,000, preferably at least 10,000.

The present invention is illustrated by FIGS. 1 to 3, of which

Figure 1:
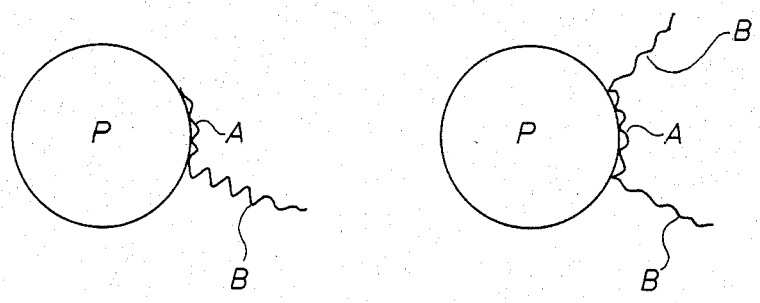
FIG. 1 represents the adsorption of a block copolymer to pigment.

The absorbent group A acts as an anchor to the pigment particles whereto it is adsorbed, and the solvatable group(s) B remain in the non-polar organic carrier liquid, e.g. a mainly aliphatic hydrocarbon liquid, surrounding the pigment particles, thus providing a steric barrier to prevent direct pigment contact. The adsorption of AB and BAB block copolymers to pigment particles P is shown schematically in FIG. 1.

The term "polystyrene" used herein includes polymerized unsubstituted vinyl, and polystyrene containing recurring units carrying one or more non-ionic substituents e.g. halogen, nitro or methyl substituent in the benzene group and/or in the ethylene group derived from the vinyl group.

The term "polymethacrylate fatty alcohol ester" includes a polymethacrylate wherein the ester groups contain at least 6C-atoms e.g. poly(hexyl methacrylate), poly(dodecyl methacrylate), poly(lauryl methacrylate) and poly(octadecyl methacrylate) also called poly(stearyl methacrylate) designated as PSMA, polystyrene being designated as PS.

All synthetic polymers have a molecular weight distribution. In order to characterize a polymer sample a molecular weight distribution curve is determined by measuring different average values for the molecular weight. This may be determined by fractionating the polymer in different molecular weight parts.

Figure 2:
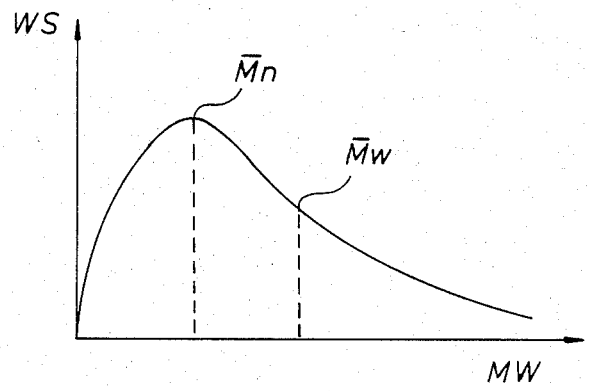
FIG. 2 is a typical molecular weight distribution curve.

A typical molecular weight distribution curve is shown in FIG. 2 (ref. Synthetic High Polymers, by G. T. Greenwoord and Banks—Oliver & Boyd, Edinburgh (1968) p. 37). The distribution curve has the molecular weight (MW) along the abscissa and the weight of polymer in size interval (WS) along the ordinate. Said curve contains different average values for the molecular weight. The two most frequently used average values are number-average molecular weight $\overline{M}_n$, and the weight-average molecular weight $\overline{M}_w$. For $\overline{M}_n$ the simple arithmetic mean is expressed mathematically by:

$$\overline{M}_n = M_1(n_1/\Sigma n_i) + M_2(n_2/\Sigma n_i) + \ldots + M_i(n_i/\Sigma n_i)$$

wherein $n_1$ is the number of molecules of molecular weight $M_1$, $n_2$ the number of molecular weight $M_2$, and so on. The summation, $\Sigma n_i$, is the total number of molecules present, thus each term $(n_i/\Sigma n_i)$ is the mole fraction of any species.

Another mathematical form of this expression is:

$$\overline{M}_n = \Sigma n_i M_i / \Sigma n_i$$

In the present examples the fractionating of the block-copolymers in narrow molecular weight fractions is done by gel-permeation chromatography (GPC) (ref. Journal of Polymer Science: Part C, No. 8, pp. 253–268). The GPC method being a physical method measures a distribution of molecular volumes so that it requires calibration. For linear polymers, which is the case in the present invention, the logarithm of molecular weight is linear over wide limits when plotted against elution volume (ref. Encyclopedia of Polymer Science and Technology—Vol. 13 (1970) p. 214).

As an alternative a chemical method has been used viz. $\overline{M}_n$ is likewise determined by titration ($\overline{M}_{n\ tit}$) of the carboxyl end groups or hydroxyl end groups.

The weight-average molecular weight $\overline{M}_w$ is a function of the mass of the molecule having its influence on light-scattering. Mathematically $\overline{M}_w$ is defined as follows:

$$\overline{M}_w = M_1(n_1M_1/\Sigma n_iM_i) + M_2(n_2M_2/\Sigma n_iM_i) + \ldots + M_i(n_iM_i/\Sigma n_iM_i)\overline{M}_w = \Sigma n_iM_i^2/\Sigma n_iM_i$$

wherein: $(n_iM_i/\Sigma n_iM_i)$ is the weight-fraction of each species. (ref. Synthetic High Polymers, by C. T. Greenwood and W. Banks—Oliver & Boyd, Edinburgh (1968) p. 36–39 and 144–145).

The ratio $\overline{M}_w/\overline{M}_n = D$ is used as a measure of the molecular-weight distribution. A ratio of $D=1$ relates to a completely monodisperse polymer (ref. Encyclopedia of Polymer Science and Technology, Vol. 7 (1967) p. 832).

Various methods for the preparation of block copolymers are described in Advances in Polymer Sci., 29, (1978) p. 85–157.

Block copolymers having a AB block structure can be prepared by an esterification reaction using A and B homopolymers each containing one reactive end group capable of an esterification reaction.

Block copolymers having a BAB block structure can be prepared by an esterification reaction using a homopolymer A with two reactive end groups and a homopolymer B with one reactive end group capable of an esterification reaction.

In another type of block copolymer the A and B homopolymer blocks have each a same reactive end group and are joined by a small bifunctionally reactive chain linking molecule.

Further block copolymers can also be obtained by an ionic mechanism using what is called a "living polymer". The term "living polymer" was coined for polymers with reactive carbanion chain ends still present when the polymerization is complete. For more particulars about that preparation mechanism and the preparation of block copolymers in general reference is made to Encyclopedia of Polymer Science and Technology Vol. 2 (1965) p. 485–528.

A further preparation technique based on interfacial coupling is described in the 27th International Symposium on Macromolecules (Strasbourg—July 1981, Volume 1, p. 107.

The preparation of block copolymers for use according to the invention is hereinafter particularly described.

1. Synthesis of polystyrene homopolymer (PS) with one terminal carboxyl group 60 mg of 4,4'-azo-bis(4-cyanovaleric acid), 228 ml of styrene and 149.5 mg of 3-mercapto-propionic acid dissolved in 170 ml of dioxane, were introduced into a three-necked reaction flask provided with a nitrogen-inlet, reflux-cooler and dropping funnel.

The polymerization reaction was effected under a nitrogen stream at a temperature of 80° C. At intervals of 6 minutes over a periode of 4 hours 1 ml of a solution consisting of 339.2 mg of 3-mercapto-propionic acid in 40 ml of dioxane is added. After said 4 h the obtained polymer was purified by precipitating twice in methanol. Yield: 18 g. The results are set forth in Table 1.

TABLE 1

(PS) with one carboxyl group

| No. (PS) | $\overline{M}_n$ | $\overline{M}_w$ | D | y = mg KOH/g of polymer | z = eq. acid/ g of polymer | $\overline{M}_{n\ tit.}$ |
|---|---|---|---|---|---|---|
| 1 | 14,500 | 26,100 | 1.8 | 4.34 | $7.75\ 10^{-5}$ | 12,900 |
| 2 | 11,800 | 23,600 | 2.0 | 4.55 | $8.13\ 10^{-5}$ | 12,500 |
| 3 | 5,000 | 7,500 | 1.5 | 9.41 | $1.68\ 10^{-4}$ | 5,900 |
| 4 | 4,700 | 6,600 | 1.39 | 12,15 | $2.17\ 10^{-4}$ | 4,600 |
| 5 | 3,500 | 4,500 | 1.28 | 15.57 | $2.78\ 10^{-4}$ | 3,600 |
| 6 | 3,400 | 4,300 | 1.26 | 15.12 | $2.70\ 10^{-4}$ | 3,700 |
| 7 | 3,300 | 4,200 | 1.28 | 19.32 | $3.45\ 10^{-4}$ | 2,900 |

The number average molecular weight ($\overline{M}_n$) and weight average molecular weight $\overline{M}_w$ was determined by GPC.

The $\overline{M}_n$ value was determined likewise by titration; $z \times 56 \times 1000 = y$ and $\overline{M}_{n\ tit} = 1/z$.

The "acidity" due to the carboxyl end groups of the (PS)-homopolymer was determined by titration in dry dioxane using an ethanolic sodium hydroxide solution and as indicator phenolphthaleine.

2. Synthesis of polystyrene with two terminal carboxyl groups 40 ml of styrene and 10 g of 4,4'-azobis-4-cyano-valeric acid were dissolved in 280 ml of dioxane, the oxygen of the air being removed by bubbling through nitrogen gas. The polymerisation reaction proceeded for 16 h at 80° C. The reaction mixture was then concentrated to half of its initial volume and the polymer precipitated twice in ice-cooled methanol.

The two terminal carboxyl groups were introduced by using the above 4,4'-azobis-4-cyano-valeric acid in the mentioned relatively large amount. The results are set forth in Table 2.

TABLE 2

(PS) with two terminal carboxyl end groups

| No. (PS) | $\overline{M}_n$ | $\overline{M}_w$ | D | y = mg KOH/g of polymer | z = eq. acid/ g of polymer | $\overline{M}_{n\ tit.}$ |
|---|---|---|---|---|---|---|
| 8 | 20,800 | 45,300 | 2.2 | 4.42 | $7.9\ 10^{-5}$ | 25,300 |
| 9 | 18,100 | 46,300 | 2.6 | 4.70 | $8.4\ 10^{-5}$ | 23,800 |
| 10 | 11,000 | 21,400 | 1.9 | 9.02 | $1.61\ 10^{-4}$ | 12,400 |
| 11 | 10,600 | 19,000 | 1.8 | 9.07 | $1.62\ 10^{-4}$ | 12,300 |
| 12 | 8,000 | 12,800 | 1.6 | 11.93 | $2.13\ 10^{-4}$ | 9,400 |
| 13 | 5,700 | 8,400 | 1.5 | 18.65 | $3.33\ 10^{-4}$ | 6,000 |
| 14 | 5,000 | 7,200 | 1.4 | 19.66 | $3.51\ 10^{-4}$ | 5,700 |
| 15 | 4,000 | 4,800 | 1.2 | 28.00 | $5.00\ 10^{-4}$ | 4,000 |
| 16 | 3,900 | 4,900 | 1.26 | 31.98 | $5.71\ 10^{-4}$ | 3,500 |
| 17 | 3,800 | 4,700 | 1.22 | 29.46 | $5.26\ 10^{-4}$ | 3,800 |
| 18 | 3,500 | 3,850 | 1.1 | 31.64 | $5.65\ 10^{-4}$ | 3,540 |
| 19 | 2,300 | 2,740 | 1.19 | 82.88 | $1.48\ 10^{-3}$ | 1,350 |
| 20 | 2,100 | 2,600 | 1.23 | 140.00 | $2.50\ 10^{-3}$ | 800 |

3. Synthesis of poly(stearyl methacrylate) (PSMA) with one terminal hydroxyl group In a polymerisation tube were introduced 50 g of stearyl methacrylate monomer 100 ml of anhydrous dioxane 30 mg of 4,4'-azobis(4-cyano pentanol) as polymerisation initiator, and 321 mg of mercapto ethanol as chain length controlling agent.

The polymerisation proceeded for 12 h at 60° C. after removing the oxygen of the air by bubbling through nitrogen gas.

The obtained polymer was precipitated in a large excess of methanol and the non-reacted stearyl methacrylate monomer was removed. The polymer precipitate was dissolved in benzene and precipitated again with methanol which yielded 35 g of (PSMA) hydroxyl terminated for 70%.

The number average molecular weight ($\overline{M}_n$) and average weight molecular weight ($\overline{M}_w$) values were determined by GPC.

In Table 3 a list of analogously prepared hydroxyl terminated (PSMA) is set forth. In their preparation only the amount of mercapto ethanol was changed.

TABLE 3

(PSMA) with one terminal hydroxyl group

| No. (PSMA) | $\overline{M}_n$ 1 | $\overline{M}_w$ 1 | D | $\overline{M}_n$ 2 | $\overline{M}_w$ 2 | D |
|---|---|---|---|---|---|---|
| 1 | 34,300 | 64,700 | 1.88 | 39,000 | 73,400 | 1.88 |
| 2 | 24,000 | 46,600 | 1.94 | 28,600 | 55,800 | 1.95 |
| 3 | 11,750 | 18,500 | 1.58 | 13,400 | 21,100 | 1.57 |
| 4 | 14,700 | 25,000 | 1.7 | 16,800 | 28,400 | 1.69 |
| 5 | 11,100 | 18,500 | 1.67 | 12,650 | 21,050 | 1.66 |
| 6 | 13,400 | 21,600 | 1.61 | 11,800 | 19,000 | 1.61 |
| 7 | 9,600 | 15,200 | 1.58 | 11,000 | 17,300 | 1.58 |
| 8 | 7,400 | 10,450 | 1.41 | 8,400 | 11,900 | 1.41 |
| 9 | 6,700 | 9,900 | 1.46 | 7,700 | 11,200 | 1.46 |
| 10 | 5,600 | 7,400 | 1.34 | 4,900 | 6,500 | 1.34 |

$\overline{M}_n$ 1 and $\overline{M}_w$ 1 values were determined by GPC using homopolystyrene for calibrating (ref. Journal of Polymer Science Part C No. 8 (1965), p. 257–258). The $\overline{M}_n$ 2 and $\overline{M}_w$ 2 values were obtained by calibrating on the basis of homopoly(methyl methacrylate).

In the (PSMA)—OH the hydroxyl group could not be determined directly by titration. Therefore, when titrated the hydroxyl groups were first allowed to react with succinic anhydride and the acid groups formed were determined as follows.

1 g of (PSMA)—OH was dissolved in dry pyridine. To the solution 10 g of succinic anhydride were added in 50 ml of anhydrous pyridine and heated for 12 h at 100° C. Thereupon the mixture was cooled down and treated with 500 ml of methanol.

The precipitate was three times dissolved in n-hexane and reprecipitated with methanol. After drying the obtained acid was titrated with ethanolic sodium hydroxide in anhydrous dioxane using phenolphthaleine as indicator.

Hereinafter follows general information about the synthesis of AB and BAB block copolymers using an esterification reaction between (PSMA) with one terminal hydroxyl group and (PS) with one or two terminal carboxyl groups.

The esterification reaction which actually is a condensation reaction proceeds by first transforming the free carboxyl groups into acid chloride (—COCl) groups with thionylchloride (12 h of refluxing). The excess of thionyl chloride is removed by evaporation.

4. Preparation of AB type block copolymers

Solution P 5 equivalents of (PS)—COOH were boiled for 12 h in $SOCl_2$. The excess of $SOCl_2$ was removed by evaporation together with previously added benzene and the residue was dissolved in a small quantity of benzene.

Solution Q 1 equivalent of (PSMA)—OH was subjected for 4 h to a Dean-Stark azeotropic drying with benzene. The benzene was finally totally evaporated and the stearyl methacrylate dissolved in a minor amount of anhydrous benzene.

The solutions P and Q were put together and refluxed for 3 days in the benzene medium in the presence of 0.1 ml of pyridine. Thereupon the reaction mixture was cooled down and treated with methanol. The formed precipitate was separated and stirred in n-hexane. The residue being (PS) was removed by suction filtering. The filtrate after being subjected to centrifuging at 15,000 r.p.m. was concentrated and yielded the AB type block copolymer together with a small amount of non-reacted (PSMA)—OH, which optionally can be removed.

5. Preparation of BAB type block copolymers

The dicarboxylated (PS) was first transformed in the corresponding acid chloride with $SOCl_2$ by boiling with reflux for 24 h.

The (PSMA)—OH was first subjected to a Dean-Stark drying. The acid chloride-homopolymer and hydroxyl-homopolymer were together dissolved in a small amount of benzene and mixed with 0.1 ml of pyridine whereupon the mixture was boiled with reflux for 3 days. The reaction mixture was cooled down and treated with methanol and the formed precipitate was removed by suction filtering and dried. The precipitate was dissolved in n-hexane and the non-dissolved (PS) removed by filtering. The filtrate was subjected to centrifuging at 15,000 r.p.m. and yielded after evaporation of the solvent the BAB type block copolymer. The results are set forth in Table 4.

TABLE 4

| Condensation no. | Prepolymers (PS) No. of table 1 or 2 | Prepolymers (PSMA) No. of table 3 | Copolymers % by weight of PS | (PS calibration) $\overline{M}n$ | (PS calibration) $\overline{M}w$ layer | (PS calibration) D | (PMMA calibration) $\overline{M}n$ | (PMMA calibration) $\overline{M}w$ layer | (PMMA calibration) D |
|---|---|---|---|---|---|---|---|---|---|
| 1 | 6 (Mn: 3,400) | 8 (Mw: 7,400) | 22 | 8,800 | 12,300 | 1.4 | 10,100 | 14,100 | 1.4 |
| 2 | 20 (Mn: 2,100) | 8 (Mw: 7,400) | 7.8 | 9,600 | 14,300 | 1.49 | 11,00 | 16,200 | 1.48 |
| 3 | 17 (Mn: 3,800) | 8 (Mw: 7,400) | 17 | 9,100 | 13,800 | 1.53 | 10,350 | 15,800 | 1.52 |
| 4 | 6 (Mn: 3,400) | 8 (Mw: 7,400) | 27 | 8,400 | 11,800 | 1.4 | 9,600 | 13,400 | 1.4 |
| 5 | 17 (Mn: 3,800) | 6 (Mw: 13,400) | 11.4 | 16,400 | 27,500 | 1.68 | 18,700 | 31,300 | 1.68 |
| 6 | 7 (Mn: 3,300) | 6 (Mw: 13,400) | 13.3 | 13,700 | 20,200 | 1.48 | 15,600 | 22,900 | 1.47 |
| 7 | 7 (Mn: 3,300) | 10 (Mw: 5,600) | 37 | 6,200 | 8,200 | 1.32 | 7,100 | 9,300 | 1.32 |
| 8 | 7 (Mn: 3,300) | 4 (Mw: 14,700) | 7.4 | 16,100 | 25,200 | 1.57 | 18,400 | 28,800 | 1.50 |
| 9 | 18 (Mn: 3,500) | 4 (Mw: 14,700) | 10.5 | 15,900 | 28,900 | 1.82 | 18,100 | 32,800 | 1.82 |
| 10 | 18 (Mn: 3,500) | 5 (Mw: 11,100) | 22.5 | 18,800 | 33,500 | 1.78 | 21,500 | 38,100 | 1.77 |
| 11 | 18 (Mn: 3,900) | 3 (Mw: 11,750) | 13 | 16,500 | 28,000 | 1.69 | 18,800 | 31,700 | 1.69 |

In said table 4 a list is given of AB and BAB type block copolymers indicating their starting homopolymer with number average molecular weight ($\overline{M}_n$) as given in tables 1, 2 and 3.

The $\overline{M}_n$ and $\overline{M}_w$ values of the copolymers were determined by GPC using polystyrene (PS) and poly(methylmethacrylate) (PMMA) calibration.

The percentage by weight of polystyrene in the copolymer was determined by nuclear magnetic resonance data (NMR-analysis).

According to a modified embodiment the (PSMA-)—OH is first transformed into the corresponding sodium alcoholate by refluxing in the presence of sodium metal.

The thus obtained (PS) acid chloride and (PSMA)—ONa is allowed to react in different weight ratios to obtain a large variety of block copolymers. The esterification reaction proceeds under reflux in different solvents (benzene or dioxane) and whether or not in the presence of minor amounts of pyridine (0.1 ml) or p-toluene suphonic acid (100 mg).

The obtained block copolymer is precipitates in methanol. Non-reacted polystyrene homopolymer is removed by stirring the precipitate in hexane whereupon from the filtrate the purified block copolymer is separated by evaporating the solvent.

6. Synthesis of AB block copolymers by linking monohydroxyl terminated homopolymers (PS)—OH and (PSMA)—OH through chlorocarbonyl isocyanate (ClCO—NCO)

The linking reaction was carried out in a three-necked reaction flask provided with a nitrogen-inlet tube, cooler, dropping funnel, thermometer and magnetic stirrer.

Moisture was kept out of the flask by bubbling through dry nitrogen.

In a first step a 10% by weight solution of (PSMA-)—OH in anhydrous decalin (decahydronaphthalene) with a two-fold excess by volume of benzene was subjected to azeotropic distillation removing hereby 30 to 40% of the benzene. The solution was cooled down to 0°-5° C. and thereupon a five fold volume with respect to the volume of ClCO—NCO in the flask was added. The reaction mixture was stirred for 2 h at about 5° C. and thereupon for 5 h at room temperature (20° C.). The residual benzene together with the excess of ClCO—NCO (boiling point 63° C.) was removed by distillation. Hereby HCl-gas was set free and the distillation was continued up to absence of HCl which was detected with a silver nitrate solution.

To the reaction mixture an equivalent amount of (PS)—OH (the preparation of which is analogous to that of PSMA—OH) in anhydrous dioxane was added and the reaction continued for 24 h at 140° C. Thereupon the reaction mixture was cooled down and the block copolymer was precipitated with methanol. The precipitate was redissolved in n-hexane. The residual solid (PS) was removed by centrifuging. The number average molecular weight ($\overline{M}_n$) of the copolymer determined by GPC was 17,200, the $\overline{M}_n$ of PS—OH being 8,000 and of PSMA—OH being 7,700.

According to a particular embodiment the block copolymer used in the present liquid electrophoretic developer composition is given an ionic character by introducing in the adsorbent group A through copolymerisation onium salt units as described in U.S. patent application Ser. No. 06/563,561. Such can be done by copolymerisation of styrene monomer with vinylbenzyl chloride in the presence of relatively large amounts of 4,4'-azobis(4-cyano-valeric acid).

In the thus obtained block A groups having two terminal carboxyl end groups these groups are transformed into carboxylic acid chloride groups which are used to form a block copolymer chain B-A-B by a condensation reaction with mono-hydroxypolyalkyl methacrylate groups B. In the obtained B-A-B block copolymers the reactive halogen of the vinylbenzyl chloride units is used in a quaternisation reaction to introduce organic onium groups in the polymer chain, in other words to obtain a copolymer chain of styrene and vinylbenzyl onium units associated with counter anions. The counter anions associated with these organic onion groups have preferably a voluminous size and are therefor e.g. of the type described in said U.S. patent application Ser. No. 06/563,561.

A detailed preparation of a block copolymer with onium groups derived from vinylbenzyl chloride and voluminous counter anions is given hereinafter.

Step 1

In a polymerisation tube 38.5 ml of styrene (PS), 3.83 g of vinylbenzyl chloride (VBCl) and 4 g of 4,4'-azobis(4-cyano-valeric acid) (ACVZ) in 200 ml of dioxane were introduced under a protective cover of dry nitrogen gas. The mixture was heated with reflux for 16 h at 80° C. Thereupon the reaction mixture was poured into cold methanol wherein the copolymer of styrene and vinylbenzyl chloride precipitated. The copolymer contained 8 mol % of vinylbenzyl chloride units and ended in two terminal carboxyl groups stemming from the ACVZ polymerisation radical former.

The $M_n$ value obtained by titration was 5,900. In an analogous way copolymers containing up to 30 mol % of vinylbenzyl chloride units were produced, but higher contents are introducable.

Step 2

To 1 g of the copolymer obtained in step 1 50 ml of fresh distilled thionyl chloride was added in dry conditions and kept boiling with reflux for 12 h. Thereupon the reaction mixture was evaporated to dry in a rotary evaporator using benzene for removing any traces of thionyl chloride. To the obtained copolymer having terminal acid chloride groups an equivalent amount of polyoctadecyl methacrylate also called poly(stearyl methacrylate) (PSMA) with one terminal hydroxyl group, i.e. PSMA—OH, was added in a mixture of 45 ml of benzene and 0.5 ml of pyridine. The PSMA—OH polymer was dried in a Dean and Stark apparatus before use and was prepared as described hereinbefore. It had a $\overline{M}_n$ value of 9.304.

The reaction mixture was allowed to boil with reflux for 3 days, whereupon the block copolymer was precipitated in methanol. The precipitate was separated, dissolved again and treated with n-hexane whereby the non-reacted PS—VBCl was precipitated and removed by centrifuging.

Step 3

The block copolymer obtained in step 2 was subjected to a quaternisation reaction by dissolving 1 g thereof in a mixture of 10 ml of nitromethane, 15 ml of dioxane, 10 ml of pyridine (or 10 ml of triethylamine). The reaction mixture was allowed to boil with reflux for 24 h. Thereupon the solution was evaporated till dry in a rotary evaporator. The residue was dissolved again and precipitated in cold methanol. The obtained block copolymer contained triethylammonium groups associated with chloride ions as counter anions.

Step 4

The chloride anions of the block copolymer obtained in step 4 were exchanged against tetraphenylboride anions by dissolving said copolymer first in hexanol and adding to the solution, while stirring, a concentrated solution of sodium tetraphenyl boride. The precipitate was separated by suction filtering and dissolved in chloroform. The quaternised copolymer with tetraphenyl boride anions was purified by repeated precipitation with methanol.

In an analogous way vinylbenzyl chloride groups can be introduced into a copolymer containing alkyl methacrylate groups and having one terminal hydroxyl group. For that purpose azo-bis(cyano pentanol) (ACP) is used as polymerisation initiating agent and mercaptoethanol as chain length regulator.

The procedure is described in the following steps A and B.

Step A

In a polymerisation tube 25 g of stearyl methacrylate monomer, 75 ml of dioxane, 15 mg of ACP, 160.5 mg of mercapto-ethanol and 1.12 g of vinylbenzyl chloride were introduced. The reaction mixture was heated for 12 h at 60° C. under a cover of dry nitrogen gas. Thereupon the copolymer VBCl—PSMA—OH was purified by precipitating twice in cold methanol.

Up to 20 mol % of VBCl could be copolymerized that way.

Step B

A homopolymer polystyrene (PS) containing two terminal carboxyl groups prepared as described above was condensed in the form of the corresponding acid chloride with the VBCl—PSMA—OH copolymer of step A. For that purpose 1 g of polystyrene having two terminal carboxyl groups was boiled with reflux for 12 h with about 50 ml of fresh distilled thionyl chloride. After that period any traces of thionyl chloride were removed by evaporation (twice) in the presence of benzene.

In the obtained acid chloride styrene polymer an equivalent amount of VBCl—PSMA—OH copolymer was added in benzene in completely anhydrous conditions in the presence of 0.5 ml of pyridine. The reaction mixture was allowed to boil with reflux for 3 days and thereupon the obtained block copolymer was precipitated in methanol. Purification proceeded by redissolving in chloroform and by introduction in n-hexane the non-reacted polystyrene precipitated. It was removed by centrifuging. The clear solution left was treated with a mixture of pentane/isopropanol from which the block copolymer was isolated and subjected to quaternisation and anion exchange as described above in steps 3 and 4.

The organic polymeric material has the property of adhering to the pigment particles and of serving as a protective colloid in non-aqueous medium. The organic polymeric material on the pigment particles operates as a dispersing aid and may be considered as an oleoresinous wetting agent. The coating of polymeric material confers on the toner developer a better shelf life stability by sterical hindrance.

The dispersion stability of the developer composition is influenced by the amount of said copolymer which is present in an amount of preferably at least 0.020 g per g of dry pigment particles. Optimal amounts for each pigment can be determined by simple tests.

The insulating liquid used as carrier liquid in which the polymethacrylate fatty ester part of the block copolymer is solvatable may be any kind of non-polar, fat-dissolving solvent. Said liquid is preferably a hydrocarbon liquid e.g. an aliphatic hydrocarbon such as hexane, cyclohexane, iso-octane, heptane or isododecane, a fluorocarbon or a silicone oil. Thus, the insulating liquid is e.g. isododecane or a commercial petroleum distillate, e.g. a mixture of aliphatic hydrocarbons preferably having a boiling range between 150° C. and 220° C. such as the ISOPARS G, H, K and L (trade marks) of Exxon and SHELLSOL T (trade mark) of the Shell Oil Company.

The pigment substance used in the toner particles may be any inorganic pigment (said term including carbon) or solid organic dyestuff pigment commonly employed in liquid electrostatic toner compositions. Thus, for example, use can be made of carbon black and analogous forms thereof e.g. lamp black, channel black and furnace black e.g. Russ Printex 140 geperlt (trade-name of DEGUSSA—Frankfurt/M, W. Germany).

Typical solid organic dyestuffs are so-called pigment dyes, which include phthalocyanine dyes, e.g. copper phthalocyanines, metal-free phthalocyanine, azo dyes and metal complexes of azo dyes.

The following dyes in pigment form are given for illustration purposes only: FANALROSA B Supra Pulver (trade-name of Badische Anilin- & Soda-Fabrik AG, Ludwigshafen, Western Germany), HELIOGENBLAU LG (trade-name of BASF for a metal-free phthalocyanine blue pigment), MONASTRAL BLUE (a copper phthalocyanine pigment, C.I. 74, 160). HELIOGENBLAU B Pulver (trade-name of BASF), HELIOECHTBLAU HG (trade-name of Bayer AG, Leverkusen, Western Germany, for a copper phthalocyanine (C.I. 74,160), BRILLIANT CARMINE 6B (C.I. 18,850) and VIOLET FANAL R (trade-name of BASF, C.I. 42,535).

Typical inorganic pigments include black iron(III) oxide and mixed copper(II) oxide/chromium(III) oxide/iron(III) oxide powder, milori blue, ultramarine cobalt blue and barium permanganate. Further are mentioned the pigments described in the French Pat. Nos. 1,394,061 filed Dec. 23, 1963 by Kodak Co., and 1,439,323 filed Apr. 24, 1965 by Harris Int. Corp.

Preferred carbon black pigments are marketed by DEGUSSA under the trade name PRINTEX. PRINTEX 140 and PRINTEX G are preferably used in the developer composition of the present invention. The characteristics of said carbon blacks are listed in the following Table 5.

TABLE 5

| | PRINTEX 140 | PRINTEX G |
|---|---|---|
| origin | channel black | furnace black |
| density | 1.8 g · cm$^{-3}$ | 1.8 g · cm$^{-3}$ |
| grain size before entering the developer | 29 nm | 51 nm |
| oil number (g of linseed oil adsorbed by 100 g of pigment) | 360 | 250 |
| specific surface (sq. m per g) | 96 | 31 |
| volatile material % by weight | 6 | 2 |
| pH | 5 | 8 |
| colour | brown-black | blue-black |

As colour corrector for the PRINTEX pigments preferably minor amounts of copper phthalocyanine are used, e.g. from 1 to 20 parts by weight with respect to the carbon black.

For a given charge density of the charge-carrying surface the maximum development density attainable with toner particles of a given size is determined by the charge/toner particle mass ratio, which is determined substantially by the amount of electrical polarity controlling substance employed.

In contrast to dry toners the liquid suspended toner particles acquire normally their negative or positive charge from a chemical dissociation reaction on the toner particle surface and the introduction of a charged species in the carrier liquid to form the counterion. The principal charging mechanisms operating with a dissociation reaction are described e.g. by Robert B. Comizolli et al. in Proceedings of the IEEE, Vol. 60, No. 4, April 1972, p. 363–364.

So, a liquid developer composition according to the present invention includes at least one substance (called "charge control" agent or substance) which influences or is responsible for electrical charging of the toner. The charge control substance(s) may have positive or negative charging effect. Mostly oil-soluble ionogenic substances (surfactants) e.g. metallic salts of organic acids with long aliphatic chain (e.g. containing at least 6 carbon atoms) are used for that purpose. By predominant adsorption of one ionic species the toner particles receive a net charge whose amount can be regulated by changing the additive concentration. In this way the sensitivity of the toner (i.e. deposited mass per surface charge) can be controlled. The polarity can be determined by appropriate choice of the surfactant. For example, a suspension of carbon black in liquid isoparaffins becomes negatively charged by overbased calcium petroleum sulphonate and positively charged by calcium diisopropyl salicylate. Mixtures of different charge control agents can be used. For example a mixture of different charge control agents having opposite charging effects can be used so that the strength of the charge on the toner or the polarity thereof can be adjusted by varying the ratio between the different agents (see U.K. Patent Specifications No. 1,411,287-1,411,537 and 1,411,739, all filed July 12, 1972 by Agfa-Gevaert N.V.). Particularly suitable positively working charge control substances are described in the United Kingdom Patent Specification No. 1,151,141 filed Feb. 4, 1966 by Gevaert-Agfa N.V. These substances called charge control agents are bivalent or trivalent metal salts of:

(a) a monoester or diester of an oxyacid derived from phosphorus, (b) an oxyacid derived from phosphorus and containing one or two organic groups linked to the phosphorus atom by a carbon atom, or (c) an oxyacid derived from phosphorus and containing an ester group and an organic group linked by a carbon atom to the phosphorus atom, said organic group being aliphatic, cycloaliphatic or aromatic.

The organic group preferably comprises a chain of at least 4 carbon atoms, most preferably from 10 to 18 carbon atoms, and such chain may be substituted and/or interrupted by hetero-atoms, e.g., oxygen, sulphur, or nitrogen atom(s).

Particularly good results are obtained with zinc salts. However, other salts may also be used e.g. magnesium salts, calcium salts, strontium salts, barium salts, iron salts, cobalt salts, nickel salts, copper salts, cadmium salts, aluminium salts and lead salts.

The solubility in the electrically insulating carrier liquid of such metal salts can be promoted by the presence of one or more organic groups with branched structure, e.g. branched aliphatic groups, such as a 2-butyl-octyl group.

Other particularly suitable positively working charge control agents that are of special interest in the production of an electrophoretic developer with low charge/-toner particle mass ratio are the metal alkyl sulphonates described in the United Kingdom Patent Specification No. 1,571,401 filed Sept. 16, 1975 by Agfa-Gevaert N.V.

Still other suitable positively working charge control agents are described in the European Patent Application No. 83 2000 85.5 filed Jan. 20, 1983 by Agfa-Gevaert N.V.

A liquid developer composition according to the present invention can be pepared by using dispersing and mixing techniques well known in the art. It is conventional to prepare by means of suitable mixers e.g. a 3-roll mill, ball mill, colloid mills, high speed stirrers, a concentrate of e.g. 15 to 80% by weight of the solid materials selected for the composition in the insulating carrier liquid and subsequently to add further insulating carrier liquid to provide the liquid toner composition ready for use in the electrostatic development process. It is generally suitable for a ready to use electrophoretic liquid developer to incorporate the toner in an amount between 0.3 g and 20 g per liter, preferably between 1 g and 10 g per liter.

The copolymer can be applied as a pre-coating on the pigment particles prior to their use in the developer or can be introduced as a separate ingredient in the liquid and allowed to become adsorbed onto the pigment particles.

The electrophoretic development may be carried out using any known electrophoretic development technique or device. The field of the image to be developed may be influenced by the use of a development electrode. The use of a development electrode is of particular value in the development of continuous tone images. When no development electrode is used, the developed image may exhibit exaggerated density gradients which may be of interest e.g. in certain medical X-ray images for diagnostic purposes.

The following examples illustrate the present invention.

All parts, ratios and percentages are by weight.

EXAMPLE 1

Preparation of carbon black dispersion 1.

50 ml of a 2% solution of the copolymer of condensation no. 10 according to Table 4 in isododecane were added to 4 g of carbon black PRINTEX G (trade name). The carbon black was dispersed in a 250 ml mini-ball-mill for a period of 16 h.

Toner dispersion

From the obtained toner concentrate 2 ml were taken and diluted with 500 ml of isododecane.

EXAMPLE 2

Preparation of carbon black dispersion 2.

Example 1 was repeated with the difference, however, that the copolymer of condensation no. 6 was used instead of no. 10.

EXAMPLE 3 (comparative example)

Preparation of carbon black dispersion 3.

Example 1 was repeated with the difference, however, that the copolymer of condensation no. 7 was used instead of no. 10.

EXAMPLE 4

Preparation of carbon black dispersion 4.

Example 1 was repeated with the difference, however, that the copolymer of condensation no. 1 was used instead of no. 10.

Figure 3:
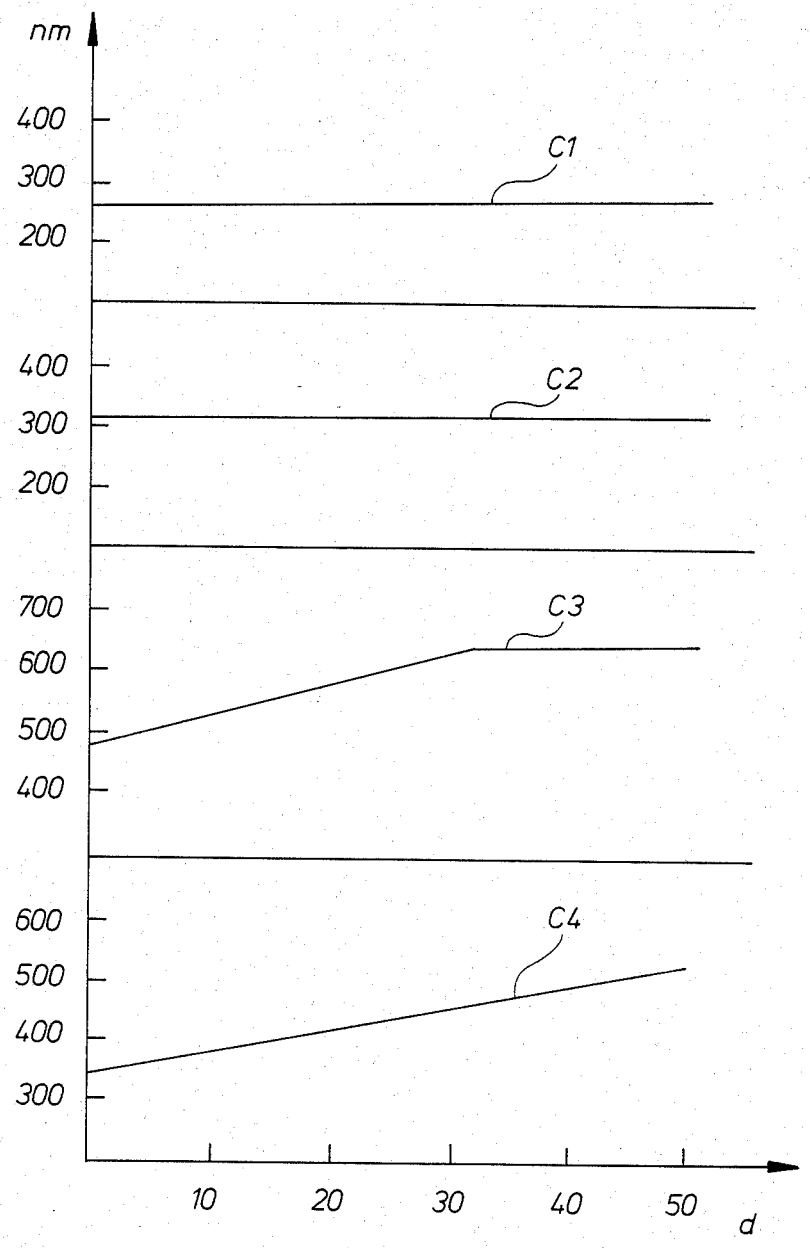
FIG. 3 are dispersion stability diagrams (particle size versus storage time).

The change of the particle size in the toner dispersions 1 to 4 was followed over a period of 50 days. In the accompanying FIG. 3 diagrams are represented wherein average particle size diameter in (nm) is put versus time in days (d).

From said diagrams can be learned that the carbon black dispersions with block copolymers used in the Examples 1 and 2 (see curves $C_1$ and $C_2$ respectively) contain already from the start particles of smaller size and maintain a finer size over the defined period.

A short PSMA-block as exemplified in condensation product no. 7 (Example 3) yields a coarser particle size already from the start and cannot prevent conglomeration with time.

The condensation product no. 1 yields a sufficiently fine particle size at the start and a relatively slow speed of conglomeration being at the limit of desired stabilisation.

The average diameter of the toner particles was measured with the COULTER (trade mark) NANOSIZER. The measuring principles used in this instrument are those of Brownian motion and autocorrelation spectroscopy of scattered laser light. The frequency of this Brownian motion is inversely related to particle size.

EXAMPLES 5-9

Example 1 was repeated with the difference, however, that to the dispersion were added respectively 2 mg, 10 mg, 20 mg, 50 mg and 100 mg of zinc mono-2-butyl-octyl phosphate as charge controlling agent conferring a positive charge to the dispersed carbon black particles.

The toner particle size did not show a material change over a 50-day period which proves that the dispersion stability is mainly due to the adsorbed block copolymer.

The $Q_T$ value which is a measure for the charging of the toner particles was increasing in direct relationship to the amount of charge controlling agent (see Table 6).

TABLE 6

| Charge controlling agent (mg) | $Q_T$ | Particle diameter (nm) Start | After 50 days |
|---|---|---|---|
| 0 | 0 | 189 | 239 |
| 2 | $+6.5 \times 10^{-8}$ C | 215 | 173 |
| 10 | $+10.5 \times 10^{-8}$ C | 142 | 176 |
| 20 | $+13.5 \times 10^{-8}$ C | 169 | 156 |
| 50 | $+19 \times 10^{-8}$ C | 185 | 157 |
| 100 | $+27 \times 10^{-8}$ C | 177 | 164 |

The $Q_T$ value was obtained as follows:

"In an electrophoresis cell having two planar electrodes each with a surface of 20 $cm^2$ spaced at a distance of 0.15 cm is filled with the above electrophoretic toner dispersions of which 4 ml were diluted with 1 liter of isododecane. The electric current (I) flowing between the two electrodes at a voltage puls of 500 V for 0.5 s is measured."

The current (I) is the result of a charge (Q) transport due to the inherent conductivity of the liquid without toner and the electrophoretic toner particle displacement towards one of the electrodes and the movement of its counter ions towards the other electrode. The toner-deposition (blackening) of the negative electrode (cathode) proves that the toner particles are positively charged. The $Q_T$ value is the current I in ampéres integrated over the period (t) of 0.5 s and is a measure for the charging of the toner particles.

EXAMPLE 10

The quaternized block copolymer prepared by the steps 1-4 above associated with tetraphenyl boride as counter anion, was first dissolved in methyl ethyl ketone wherein PRINTEX G (trade name) carbon black pigment was dispersed. After dispersion the solvent was evaporated leaving the copolymer coated onto the pigment particles. The copolymer-coated carbon black was then redispersed in isododecane in a ball mill. The obtained dispersed toner particles were positively charged, which was proved by zeta-potential measurement. The average toner particle diameter was about 250 nm measured as described in Example 1.

Immediately after preparation the $Q_{T1}$ value of the developer liquid was $+2.10^{-8}$ C and after 1 week standing and re-dispersing the $Q_{T2}$ value was still $+2.10^{-8}$ C.

I claim:

1. A liquid electrophoretic developer composition suitable for rendering visible electrostatically charged areas, which composition contains in an electrically insulating non-polar organic carrier liquid having a volume resistivity of at least $10^9$ ohm.cm and a dielectric constant less than 3, pigment particles carrying at least one substance conferring electric charges on said particles, dispersed with the aid of a block copolymer containing one adsorbent group A and at least one solvatable group B, characterized in that said group A is a polystyrene chain having a number average molecular weight of at least 2,000 and group B is a polymethacrylate fatty alcohol ester group having a number average molecular weight of at least 7,000.

2. Developer composition according to claim 1, characterized in that said group A has a number average molecular weight of 2,000 to 6,000 and said group B represents a polymethacrylate fatty acid ester group having a number average molecular weight of at least 10,000.

3. Developer composition according to claim 1, characterized in that the ester moiety of said polymethacrylate fatty acid ester contains at least 6 C-atoms.

4. Developer composition according to claim 3, characterized in that the moiety is a stearyl methacrylate ester group.

5. Developer composition according to claim 1, characterized in that the block copolymer has a AB block structure and is prepared by an esterification reaction using A and B homopolymers each including one reactive end group capable of an esterification reaction.

6. Developer composition according to claim 1, characterized in that the block copolymer has a BAB block structure and is prepared by an esterification reaction using a homopolymer A with two reactive end groups and a homopolymer B with one reactive end group capable of an esterification reaction.

7. Developer composition according to claim 1, characterized in that the group A is a copolymer chain of styrene and vinyl benzyl onium units associated with counter anions.

8. Developer composition according to claim 1, characterized in that the block copolymer is present in the developer composition in an amount of at least 0.020 g per g of dry pigment particles.

9. Developer composition according to claim 1, characterized in that the carrier liquid is a hydrocarbon liquid.

10. Developer composition according to claim 1, characterized in that the pigment particles are carbon black particles.

11. Developer composition according to claim 1, characterized in that the said substance conferring electric charges to said particles is an oil-soluble ionogenic substance.

12. Developer composition according to claim 11, characterized in that said substance is a bivalent or trivalent metal salt of:

(a) a monoester or diester of an oxyacid derived from phosphorus, (b) an oxyacid derived from phosphorus and containing one or two organic groups linked to the phosphorus atom by a carbon atom, or (c) an oxyacid derived from phosphorus and containing an ester group and an organic group linked by a carbon atom to the phosphorus atom, said organic group being aliphatic, cycloaliphatic or aromatic.

* * * * *